United States Patent [19]

Lyytinen

[11] Patent Number: 4,804,441

[45] Date of Patent: Feb. 14, 1989

[54] PAPER MACHINE HEADBOX AND APPROACH FLOW SYSTEM

[75] Inventor: Markku Lyytinen, Jyväskylä, Finland

[73] Assignee: Valmet Oy, Finland

[21] Appl. No.: 98,538

[22] Filed: Sep. 18, 1987

[30] Foreign Application Priority Data

Sep. 19, 1986 [FI] Finland ..... 863805

[51] Int. Cl.[4] ..... D21F 1/02

[52] U.S. Cl. ..... 162/212; 162/216; 162/336; 162/340; 162/343

[58] Field of Search ..... 162/212–214, 162/216, 123, 336–340, 343

[56] References Cited

U.S. PATENT DOCUMENTS

| | | | |
|---|---|---|---|
| 2,973,034 | 2/1961 | White, Jr. | 162/343 |
| 4,021,295 | 5/1977 | Schmaeng | 162/343 |
| 4,086,130 | 4/1978 | Justus | 162/343 |
| 4,198,270 | 4/1980 | Kurtz et al. | 162/343 |
| 4,376,014 | 3/1983 | Bergstrom | 162/336 |
| 4,687,548 | 8/1987 | Ilmoniemi et al. | 162/336 |

*Primary Examiner*—Kenneth M. Schor
*Assistant Examiner*—K. M. Hastings
*Attorney, Agent, or Firm*—Steinberg & Raskin

[57] ABSTRACT

Method and apparatus in the headbox of a paper machine and in its approach pipe system. In the headbox, pulp suspension is fed through the approach pipe system and a pressure screen arrangement, if any, to a distributing header part, from which the pulp suspension flow is conducted through a turbulence generator section and further to a lip section. A pulp suspension jet is discharged from a lip aperture of the lip section onto a forming wire or into a throat defined by a pair of forming wires. At least part of the approach pipe system, the distribution header part, and the turbulence generator section are arranged to have two or several substantially parallel pulp suspension flow passages. The different passages operate substantially simultaneously in parallel, when the headbox has been set to operate in a higher flow rate range. One or several of the substantially parallel flow passages are completely closed after the turbulence generator section, when the headbox is being set to operate in a lower flow rate range. With the aid of the substantially parallel flow arrangement, the flow rate of the headbox has been arranged to be adjustable substantially in a range from maximum flow rate to minimum flow rate, in which a ratio of maximum flow rate/minimum flow rate is about 4.

11 Claims, 4 Drawing Sheets

PAPER MACHINE HEADBOX AND APPROACH FLOW SYSTEM

BACKGROUND OF THE INVENTION

The present invention concerns a method in a headbox of a paper machine and the approach pipe system thereof. In the headbox, pulp suspension is fed through an approach pipe system and through a pressure screen arrangement thereof, if such is provided, to a distribution header part, from which the pulp suspension flow is conducted through a turbulence generator section and further to a lip section having a lip aperture. A pulp suspension jet is discharged from the lip aperture onto a forming wire or into a throat between a pair of forming wires.

The present invention further concerns a headbox arrangement in a paper machine and the approach pipe system thereof, comprising a pulp suspension feed pump and an approach pipe system. This pipe system communicates with a system attenuating pressure variations in the pulp suspension. The arrangement further comprises a distribution header part, a turbulence generator section connected thereto and to which a lip section terminating in a lip aperture is connected. A pulp suspension jet can be supplied onto a forming wire or into a throat between a pair of forming wires through the lip aperture.

In so-called variety production paper machines, which are used to make paper brands varying within very wide limits, e.g. in base weight thereof, the commonly encountered problem is that the ratio between the maximum flow rate $q_{max}$ and minimum flow rate $q_{min}$ of the pulp suspension from the headbox is too low. Such variety production machines are, as a rule, narrow and slow and would need to have a rather high value of the abovementioned flow rate ratio.

In existing headboxes, a flow ratio $q_{max}/q_{min} \approx 2$ is usually achieved. With perforated roll or air cushion headboxes, a slightly higher flow rate ratio is achieved in some instances. With certain hydraulic headboxes, even higher flow ratios than mentioned above are obtained, but in that case an exchangeable turbulence generator has to be used and the height of the pulp suspension flow passage must be changed in addition.

In procedures and designs known in the art, satisfactory flow conditions can be obtained, even at high flow ratios, in the region of the turbulence generator and the lip cone. However, in the regions of the approach pipe system, the pressure variation attenuator, and the distribution header, major flow velocity digressions cause serious disturbances, which has not been able to be satisfactorily handled in designs of the prior art. If the flow velocity in the approach pipe system, the attenuator, and distributor header markedly differs downwardly from the rated values, soiling problems are incurred in the flow system. On the other hand, if the flow velocity in such units substantially deviates upwardly from the rated velocity, then excessive turbulence results which impairs the formation and homogeneity of the web. Therefore, any substantial exceeding of the flow ratio $q_{max}/q_{min} \approx 2$ has become questionable in practice.

So-called multiple-layer headboxes are known in the art, being used in particular in cardboard machines. Such headboxes comprise a plurality of parallel pulp flow passages, each of which is connected to an individual pulp system so that different pulp can be supplied through each headbox layer in accordance with the layered design being produced.

SUMMARY OF THE INVENTION

Accordingly, it is an object of the present invention to provide a simple and well-operating solution to the problems outlined above, so that the above-noted flow ratio of $q_{max}/q_{min} \approx 4$, or even slightly higher if needed, can be achieved.

It is also an object of the present invention to provide a headbox design in which construction costs are substantially improved over a perforated roll headbox.

It is an additional object of the present invention to provide a headbox design which can be regulated quicker than previously when changing paper brand and base weight. This is a highly important feature for such usually narrow and slow variety production machines, such kinds being refurbished more and more frequently.

These and other objects are attained by the present invention which is directed to a method for a headbox of a paper machine and approach pipe system thereof, in which pulp suspension is fed through the approach pipe system of the headbox to a distribution header part from which the pulp suspension flow is conducted through a turbulence generator section and then to a lip section having an aperture through which the pulp suspension is discharged onto a forming wire or into a throat between a pair of forming wires. The method comprises the steps of dividing the pulp suspension flow into at least two substantially parallel flow paths, in at least part of the approach pipe system, the distribution header section, and the turbulence generator section, causing the divided pulp suspension flows to flow along these respective flow paths substantially parallel to one another when the headbox has been set for a higher flow rate range, and completely closing off at least one of the flow paths after the turbulence generator section, when the headbox has been set to operate in a lower flow rate range.

The present invention is also directed to an arrangement in a paper machine headbox comprising a pulp suspension feed pump, an approach pipe system communicating with the feed pump, an attenuation system for attenuating pressure variations in the pulp suspension, a distribution header part, a turbulence generator section connected to the distribution header part, and a lip section connected to the turbulence generator section and which terminates in a lip aperture, through which a pulp suspension jet can be directed onto a forming wire or into a throat defined by a pair of forming wires. The approach pipe system comprises at least two substantially parallel, pulp supply passages uniting in superimposed arrangement at the beginning of the lip section. At least one of the passages is arranged to be openable or closable. The headbox is set for operation at a lower flow rate range when the at least one passage is closed.

Therefore, for attaining the above objects and others which will become apparent below, the method of the present invention is principally characterized by at least a part of the approach pipe system, the distribution header part, and the turbulence generator section being arranged to form two or several substantially parallel pulp suspension flow passages. Both channels operate at the same time in parallel when the headbox has been set to operate in a higher flow range. One or more of the substantially parallel flow paths is/are fully closed after the turbulence generator section, when the headbox has been set to operate in a lower flow range.

The arrangement of the present invention is principally characterized by the approach pipe system comprising two or more substantially parallel pulp supply passages. These passages come together one on top of the other at the beginning of the lip cone section. One or several of these passages are arranged to be openable and closable by means of a setting switch or equivalent slide valve or valve arrangement (i.e. with an adjustment gear or an equivalent operable slide or valve arrangement). The headbox is set for the lower flow range in the latter instance, i.e. when the passag or passages is/are closed.

In an advantageous embodiment of the present invention, two or three approach pipes are provided starting from the feed pump or the pressure screens. All of the pipes have individual attenuators provided with joint adjustment and after the same, individual superimposed distribution headers. The turbulence generator, starting from the distribution headers, terminates at the beginning of the lip cone in a unitary honeycomb structure with a shoulder constituting a sealing surface. It is possible to open or close the upper part of the turbulence generator and the corresponding part of the approach pipe system against this shoulder, with a sliding valve structure on a rear edge of the upper lip and with a valve at the beginning of the respective approach pipe. The flow velocities are thereby maintained in disturbance-free ranges, while the pulp suspension flow rate varies in a range of $q_{min}:q_{max}=1:4$, or possibly within even somewhat wider limits.

The present invention differs from multiple-layer headboxes of the prior art and from the pulp supply systems thereof, in that in the present invention, a single pulp system is divided into two or more, e.g. three or four, substantially parallel feed passages through which, as a rule, a single pulp quality is supplied. Furthermore, in the present invention, one or several pulp flow passages can be closed at a suitable point when the headbox is set to operate in a lower flow range thereof. Such closing can be carried out in a manner causing no other derangement in the operation of the system.

BRIEF DESCRIPTION OF THE DRAWINGS

The present invention will now be described in greater detail below, referring to certain examples of the invention illustrated in the accompanying drawings, to which the present invention is not to be narrowly confined. In the drawings.

DESCRIPTION OF THE PREFERRED EMBODIMENTS

Figure 1:
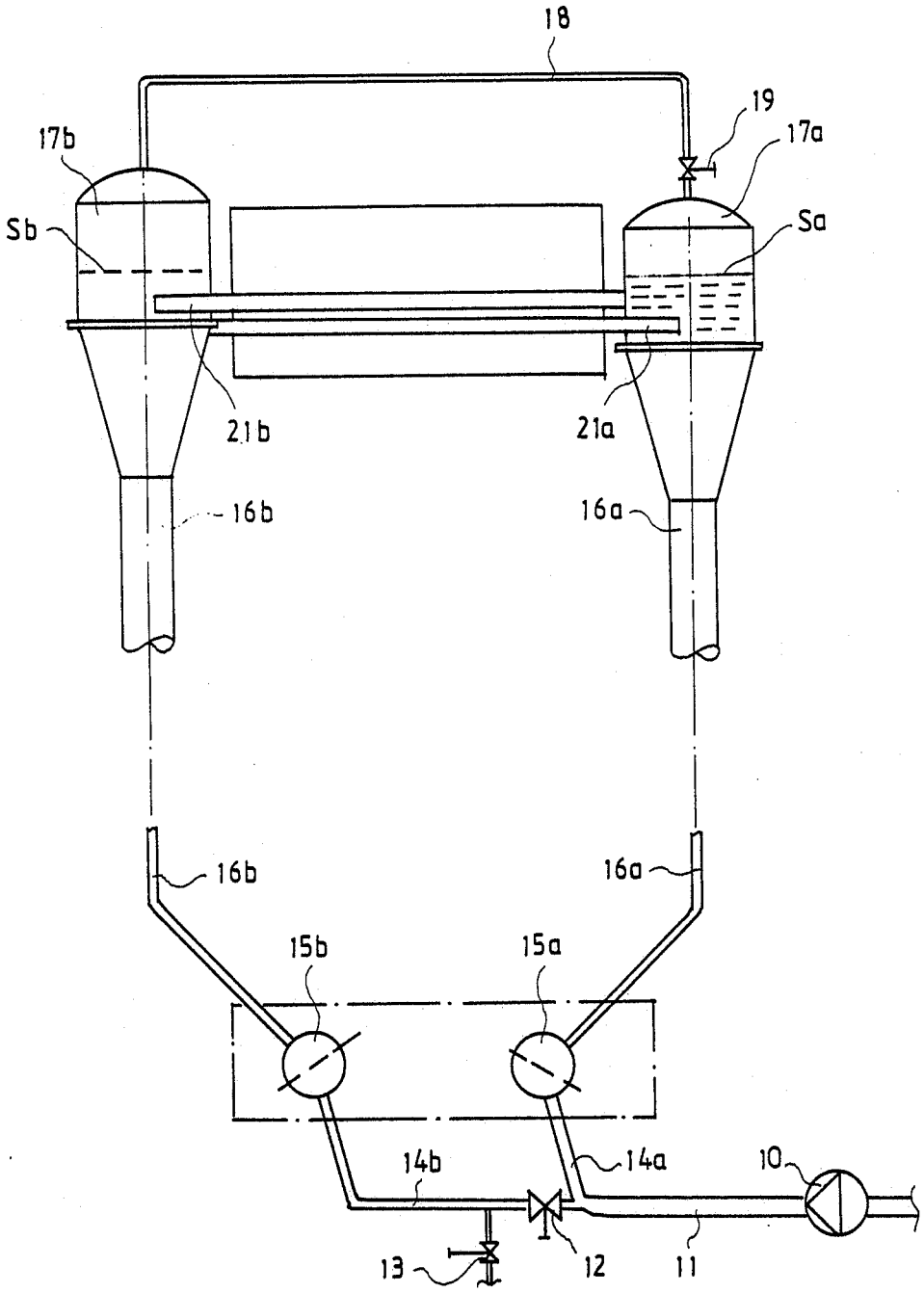
FIG. 1 is a schematic illustration of the approach pipe system of a headbox, a screen part, and an attenuator and distribution header arrangement, in accordance with the present invention.

The approach pipe system of a paper machine headbox is depicted in FIG. 1, as comprising a feed pump 10 for the headbox and a pipe 11 on a pressure side thereof, this pipe branching into pipes 14a and 14b. The pipe 14b incorporates a valve 12 and a by-pass valve 13. When the line 14b, 15b, 16b, etc., 27b, has been shut from operating, this excluded section is filled with water through valve 13 in order to avoid fiber or filler depositions therein.

The branch pipes 14a and 14b are each connected with a specific pressure screen 15a and 15b. A single screen with two taps may be alternatively used. The outlet pipes 16a and 16b extend from the respective pressure screens 15a, and 15b, each outlet pipe 16a and 16b conducting a paper pulp suspension flow to a specific attenuation tank 17a and 17b. The free surface of the pulp therein is indicated by respective reference characters $S_a$ and $S_b$. This free surface, over which a supply pressure $P_0$ acts, causes attenuation of pressure variations.

Figure 2:
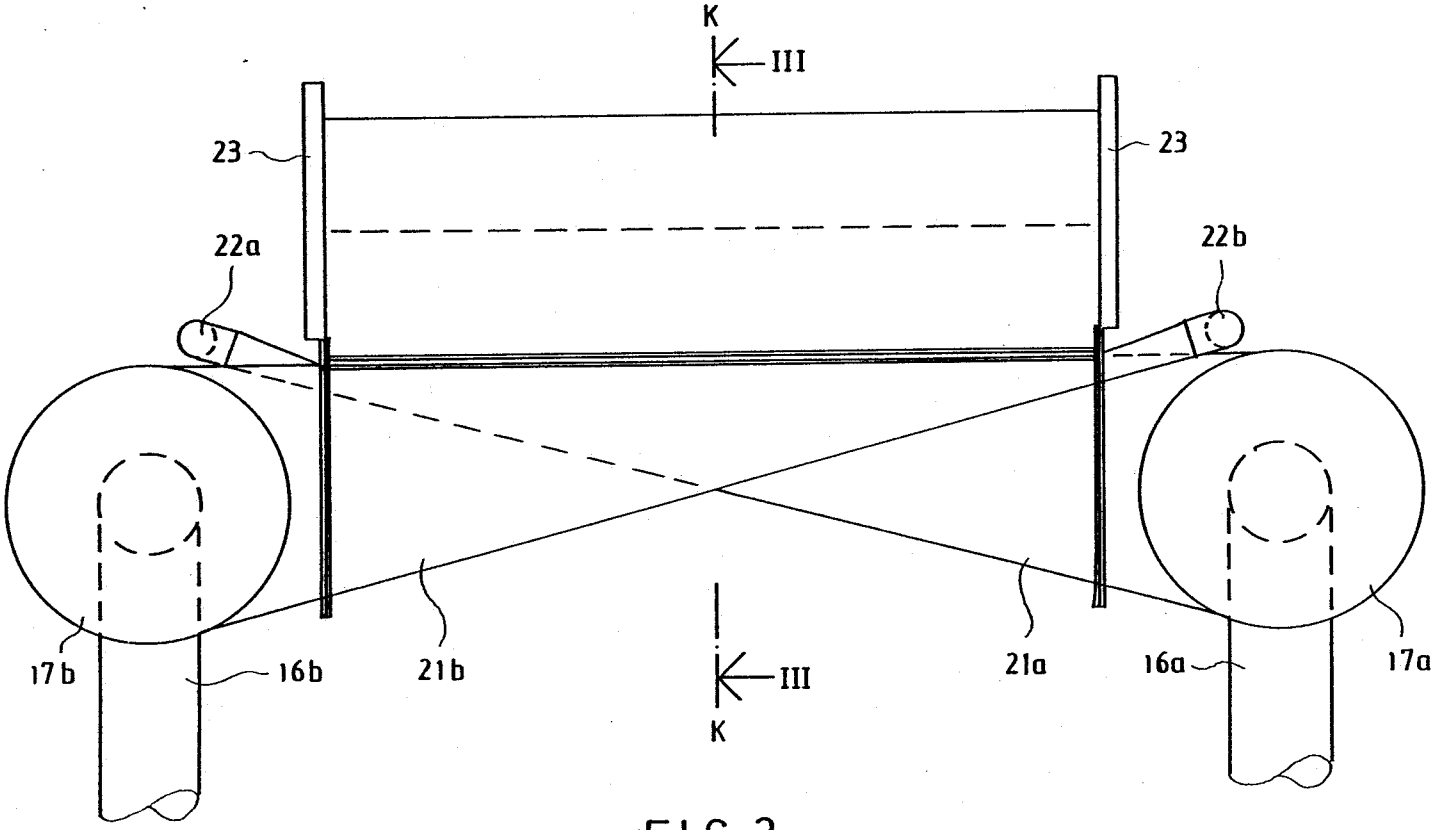
FIG. 2 is a top view of the headbox with its distribution header and attenuator arrangement.

As can be seen in FIGS. 1 and 2, a specific distribution header 21a, 21b *is connected to each attenuator 17a* and 17b, with by-pass pipes 22a and 22b being situated at the opposite ends thereof. A connecting pipe 18 provided with a valve 19 is provided between the attenuators 17a and 17b. When the valve 19 of the connecting pipe 18 is open, equal pressure $p_O$ is ensured in both attenuators 17a and 17b.

The pressure in the distribution header may be written as follows:

$P_i=P_O+P_s$, where $P_s=\rho gh$, with h=level height in the attenuator. The attenuator 17a is located somewhat lower than the attenuator 17b. Level control means are preferably provided only in connection with the lower attenuator 17a and the lower distribution header 21a.

Figure 3:
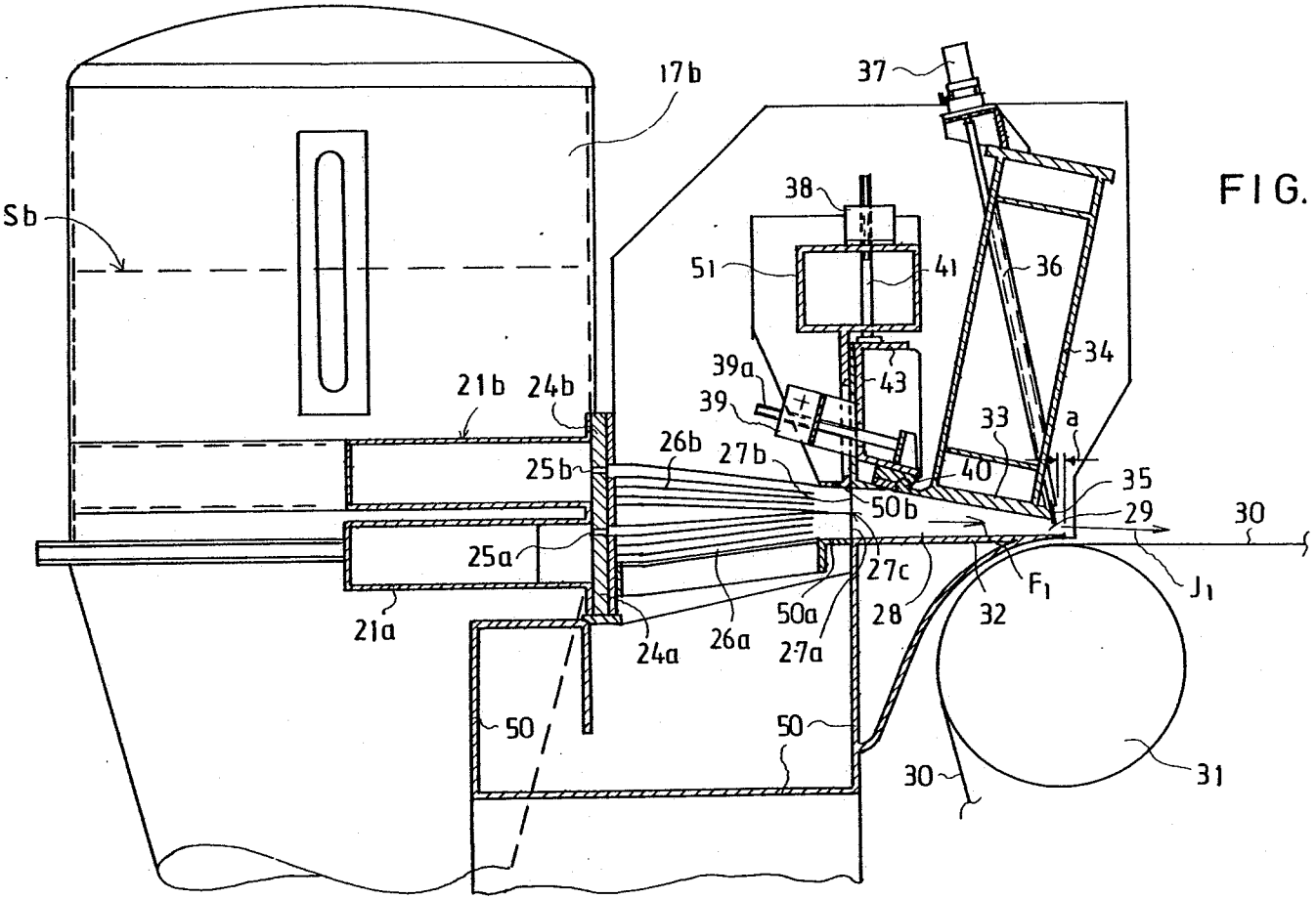
FIG. 3 is a section view along line III—III of FIG. 2, illustrating the headbox arrangement of the present invention being set to operate at a higher flow rate range thereof.

The distribution headers 21a and 21b are situated one above the other, as is best seen in FIG. 3. Both distribution headers 21a and 21b are provided with turbulence generators one above the other, comprising a vertical sheet component 24a, 24b provided with a set of perforations 25a, 25b. A turbulence generator 26a, 26b is connected to each respective perforation set 25a, 25b. Starting at a given distance from the onset side thereof, these turbulence generators 26a, 26b begin to approach one another in a manner that is apparent in FIGS. 3 and 4.

As depicted in FIG. 3, after the turbulence generator and the pipe system 26a, 26b thereof, the headbox comprises a lip cone 28 between side walls 23. The lip cone is furthermore defined by an upper wall 32 of a lower lip beam and a lower wall 33 of an upper lip beam 34. The pulp suspension flow $J_1$, $J_2$ is discharged from a lip aperture 29 defined by a crown list 35 onto a forming wire 30 which passes over a breast roll 31. A frame beam 50 with a horizontal part 50a supporting the pipe systems 26a, 26b from below, is located under the pipe systems 26a, 26b of the turbulence generator and partially under the distribution headers 21a, 21b. Adjustment spindles 36 operated by adjustment gears 37 are attached to the upper lip beam 34, by which the profile of the lip aperture 29 is regulated, and which are intended for adjusting the thickness profile b of the jet $J_1$, $J_2$.

The upper lip beam 34 is connected with a horizontal pivot 40 at a rear part of the lower wall 33 thereof. The horizontal pivot 40 is situated in conjunction with slide bodies 46 and 47 which are fitted in a groove between sliding surfaces 45*a* and 45*b*. The slide bodies 46 and 47 are adjustable in this groove in the direction of arrow A over their flange part 49, and by means of spindles 39*a* of adjustment gears 39, for adjusting the setting a of the lip aperture 29, as shown in FIG. 3.

The slide arrangement 40, 46, 47 of the upper lip beam 34 comprises an angular beam 48 which has, together with the slide part, been attached to the beam 43 and to the slide body 44. The slide body 44 slides along a vertical wall 42 of an upper beam 51 of the headbox in the direction of arrow B, braced by adjustment spindles 41 which are operated with adjustment gears 38, for accomplishing adjustment in accordance with the present invention.

As shown in FIG. 3, vertical end faces 27*a* and 27*b* of honeycomb arrays of the pipe systems 26*a* and 26*b* on both turbulence generators are open, and the lip cone 28 has its maximum height when the beam 48 with components attached thereto is in the upper or top position. In this case, an underside of a lower flange of the angular beam 48 is substantially flush with a flange 50*b* of the upper beam 51. The end faces 27*a* and 27*b* have been arranged to serve as sealing surfaces, and a step part or shoulder 27*c* is located therebetween.

When, as in FIG. 3, both pipe systems 26*a* and 26*b* of the turbulence generator are open and both parallel flow passages of the pulp suspension operate at the same time in the headbox, and furthermore the lip cone section 28 is at its full height, then the pulp suspension flow $F_1$ is discharged as a lip jet $J_1$ onto the forming wire 30 and the headbox is then set to operate in its higher flow rate range $q_{1max} \cdots q_{1min}$, in which the flow rate adjustment range is $q_{1max}/q_{1min}$ 2. This flow rate adjustment range can be accomplished by means of the arrangement illustrated in the figures, without incurring the previously outlined detriments.

Figure 4:
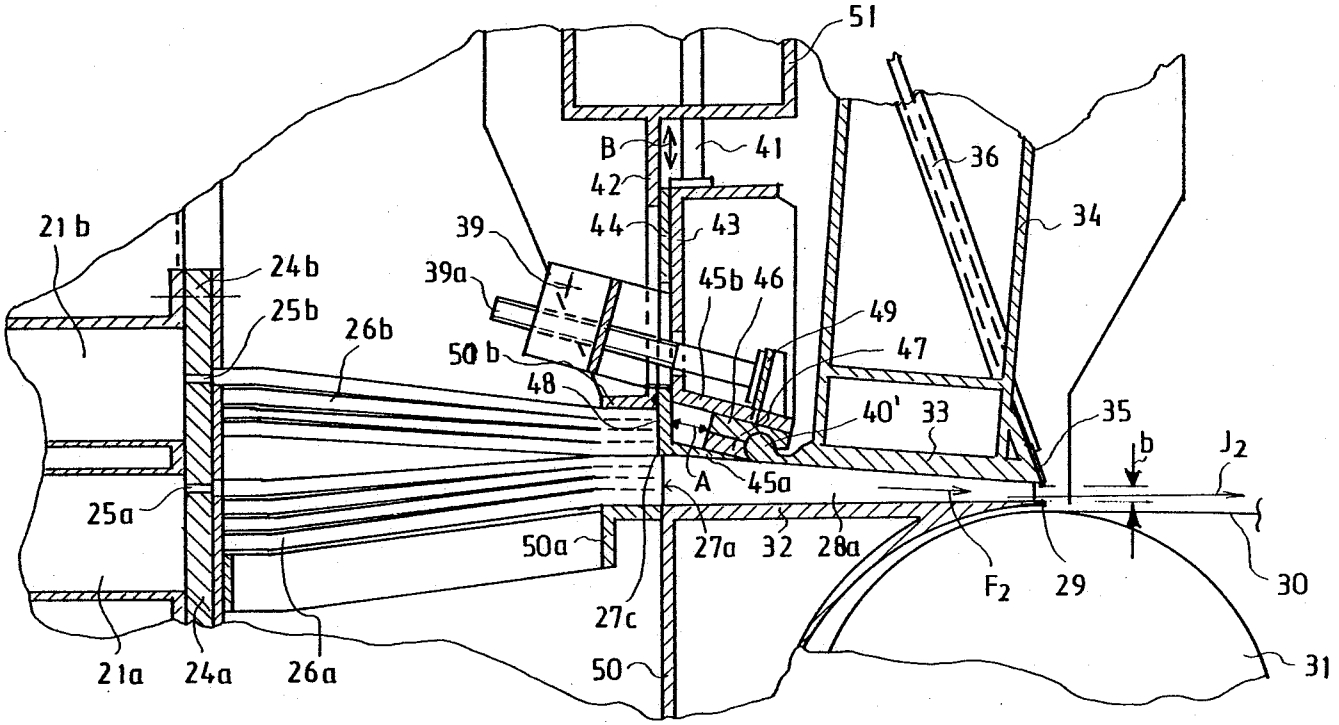
FIG. 4 is a view similar to FIG. 3 illustrating the turbulence generator, distribution pipe system, and lip section of a headbox being set to operate at a lower flow rate range thereof.

The headbox of the present invention can be set, as shown in FIG. 4, to operate in its lower flow rate range $q_{2max} \cdots q_{2min}$. In this case, the vertical flange of the angular beam 48 tightly covers the end face 27*b* of the unitary honeycomb array of the pipe system 26*b* of the upper turbulence generator, with the lower flange of the angular beam 48 resting against the step section or shoulder 27*c* of the upper side of the lower distribution pipe system 26*a*. Such setting is achieved with adjustment spindles 41 actuated by the adjustment gear 38, by moving the slide body 44 on the beam 43 downwardly along the abutment surface of the vertical wall 42. At the same time, the upper lip beam 34 with its pivot part 40' moves, turning about pivot 40', whereby the substantially horizontal flange of the angular beam 48 is placed on a level with the upper part of the honeycomb array on the outflow side of the distribution pipe system 26*a*.

In this manner, only one, i.e. the lower flow passage 14*a*, 15*a*, 16*a*, 17*a*, 21*a*, 25*a*, 26*a*, 28*a* of the pulp suspension is operable, with pulp suspension flow $F_2$ being discharged as a lip jet $J_2$ from the lip aperture 29 of the lowered lip cone 28*a*, onto the forming wire 30. In the position illustrated in FIG. 4, the headbox is set to operate in the lower flow rate adjustment range, $q_{2max}/q_{2min} \approx 2$. Therefore, the total flow rate adjustment range in the headbox arrangement of the present invention will be $q_{1max}/q_{2min} \approx 4$.

Using the arrangement of the present invention, the approach pipe system and headbox of the paper machine can be rapidly set in conjunction with any change of paper brand to be manufactured, without need to disassemble any structures or to exchange any components. This reduces the consumed time in brand-changing shut-downs, and contributes to increasing the overall efficiency of the paper machine.

Although the invention has been described in the foregoing by only referring to advantageous embodiments of the same in which two pulp suspension flow passages are used which can be opened and closed, it should be emphasized that other embodiments also belong to the scope of the inventive concepts and practical applications of the present invention as set forth above. For example, an embodiment in which more than two openable and closable pulp flow passages are used, for instance three or four substantial parallel flow passages which can be opened and closed, is conceivable in accordance with the principles presented above. When using more than two substantially parallel flow passages, even wider limits, $q_{max}/q_{min} > 4$, of the flow rate ratio in the operating headbox, may be achieved, should it be required.

The preceding description of the present invention is merely exemplary, and is not intended to limit the scope thereof in any way. Various details of the present invention may vary within the scope of the inventive concepts set forth above, and differ from what has been presented in the foregoing by way of example only.

What is claimed is:

1. In a method for controlling pulp flow to a headbox of a paper machine and approach pipe system thereof, wherein pulp suspension is fed through the approach pipe system of the headbox to a distribution header part from which the pulp suspension flow is conducted through a turbulence generator section and then to a lip section having an aperture through which the pulp suspension is discharged onto a forming wire or into a throat between a pair of forming wires, said method comprising the steps of dividing the pulp suspension flow into at least two substantially parallel flowpaths in at least part of the approach pipe system, the distribution header part, and the turbulence generator section, causing the divided pulp suspension flow to flow along these respective flowpaths substantially parallel to one another when the headbox has been set for a higher flow rate range, and completely closing off at least one of the flowpaths after the turbulence generator section, when the headbox has been set to operate in a lower flow rate range, wherein the pulp suspension flow is divided by the step of dividing the approach pipe system into at least two branches after a feed pump of the headbox, and comprising the additional step of uniting the branches only at a beginning of the lip section of the headbox.

2. The method of claim 1, wherein the pulp suspension flow is additionally fed through a pressure screen arrangement to the distribution header part.

3. The method of claim 1, comprising the additional step of adjusting the flow rate of pulp suspension through the headbox substantially over a range from maximum flow rate to minimum flow rate, wherein a ratio of maximum flow rate/minimum flow rate is about 4.

4. The method of claim 1, wherein said at least one flowpath is closed off by the step of closing an output side of a honeycomb array of an upper section of the turbulence generator with a slide arrangement situated in conjunction with an upper lip beam of the headbox, when the headbox is set to operate in the lower flow rate range, and said method comprising the additional step of fully opening the honeycomb array when the headbox is being set to operate at its higher flow rate range, whereby setting of the flow rate range through the headbox is carried out.

5. The method of claim 1, comprising the additional steps of positioning an attenuation tank along each of the divided flowpaths, whereby pressure disturbances in the pulp suspension flow are attenuated with free liquid surfaces in the attenuation tanks, and interconnecting air spaces of the attenuation tanks with a connection pipe, whereby equal pressure in all branches in the distribution header part is ensured and control with a single set of controls is made possible.

6. The method of claim 2, comprising the additional step of situating a separate pressure screen in each of the flowpaths in the approach pipe system.

7. An arrangement in a paper machine headbox comprising a pulp suspension feed pump, an approach pipe system communicating with the feed pump, an attenuation system for attenuating pressure variations of the pulp suspension, and said arrangement further comprising a distribution header part, a turbulence generator section connected to said distribution header part, a lip section which begins after and is connected to said turbulence generator section and which terminates in a lip aperture through which a pulp suspension jet can be directed onto a forming wire or into a throat defined by a pair of forming wires, wherein the approach pipe system comprises at least two substantially parallel, pulp supply passages uniting in superimposed arrangement at the beginning of the lip section, and additionally comprising means for opening and closing at least one of said passages, with said headbox being set for operation at a lower flow rate range when said at least one passage is closed, wherein said passages terminate in said turbulence generator section in respective honeycomb arrays, said honeycomb arrays including an upper honeycomb array and a lower honeycomb array, with said lower honeycomb array comprising a shoulder formed at an upper side thereof, wherein said lip section comprises an upper lip beam having a lower wall, and said opening/closing means further comprise a slide arrangement, comprising a pivot situated on said lower wall of said upper lip beam, a slide situated upon said pivot, and an angular beam engaged with said slide and movable between an upper position in which all passages of said turbulence generator section are open, and a lower position in which a vertical part of said angular beam closes the end of the upper honeycomb array, and the angular beam rests against said shoulder.

8. The arrangement of claim 7, wherein said opening/closing means additionally comprise an adjustment gear for operating said slide arrangement, for opening and closing said at least one passage.

9. The arrangement of claim 7, wherein said approach pipe system consists of two substantially parallel pulp supply passages, and said opening/closing means constitute means for opening and closing only one of said pulp feed passages.

10. An arrangement in a paper machine headbox comprising a pulp suspension feed pump, an approach pipe system communicating with the feed pump, an attenuation system for attenuating pressure variations of the pulp suspension, and said arrangement further comprising a distribution header part, a turbulence generator section connected to said distribution header part, a lip section which begins after and is connected to said turbulence generator section and which terminates in a lip aperture through which a pulp suspension jet can be directed onto a forming wire or into a throat defined by a pair of forming wires, wherein the approach pipe system comprises at least two substantially parallel, pulp supply passages uniting in superimposed arrangement at the beginning of the lip section, and additionally comprising means for opening and closing at least one of said passages, with said headbox being set for operation at a lower flow rate range when said at least one passage is closed, a first set of individual pipe branches of the approach pipe system into which said pulp suspension flow passages branch after said feed pump, individual pressure screens each communicating with a respective pipe branch, a second set of pipe branches communicating downstream with said respective pressure screens, attenuation tanks forming at least part of said attenuation system on sides of the headbox and into which respective pipe branches of said second set of pipe branches lead, a pair of distribution headers in said distribution header part, one disposed upon the other, and each communicating with a respective attenuation tank, two individual turbulence generators of said turbulence generator section, each provided at a respective front wall of a distribution header, said turbulence generators each comprising individual pipe systems approaching one another in the flow direction and forming a unitary honeycomb array opening at the beginning of the lip section.

an upper lip beam of the lip section, and slide means arranged above said lip section in conjunction with said upper lip beam thereof, for liquid-tightly sealing an upper part of the honeycomb array when the headbox is set to operate in the lower flow rate range, and for opening the same when the headbox is set to operate in the upper flow rate range.

11. The arrangement of claim 10, additionally comprising a connecting pipe interconnecting air spaces of said attenuation tanks located on both sides of the headbox and in which a feed pressure of the headbox prevails, whereby substantially equal pressure is ensured in all said distribution headers and operation with a single set of controls is made possible.

* * * * *